US009899806B2

(12) United States Patent
Maki et al.

(10) Patent No.: US 9,899,806 B2
(45) Date of Patent: Feb. 20, 2018

(54) METHOD FOR MANUFACTURING SPARK PLUG

(71) Applicant: NGK SPARK PLUG CO., LTD., Nagoya-shi, Aichi (JP)

(72) Inventors: Shunsuke Maki, Komaki (JP); Ryosuke Honda, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/407,590

(22) Filed: Jan. 17, 2017

(65) Prior Publication Data

US 2017/0214223 A1 Jul. 27, 2017

(30) Foreign Application Priority Data

Jan. 25, 2016 (JP) ..... 2016-011265

(51) Int. Cl.
*H01T 21/02* (2006.01)
*H01T 13/34* (2006.01)

(52) U.S. Cl.
CPC ..... *H01T 21/02* (2013.01); *H01T 13/34* (2013.01)

(58) Field of Classification Search
CPC ..... H01T 21/02; H01T 13/34
See application file for complete search history.

(56) References Cited

U.S. PATENT DOCUMENTS

| | | | | |
|---|---|---|---|---|
| 8,860,292 | B2 | 10/2014 | Kawai | 313/143 |
| 9,190,814 | B1 | 11/2015 | Kamada | 445/7 |
| 2014/0225496 | A1* | 8/2014 | Kawai | H01T 13/32 313/141 |

FOREIGN PATENT DOCUMENTS

| | | | |
|---|---|---|---|
| JP | 2011-175985 A | 9/2011 | H01T 13/20 |
| JP | 2016-091876 A | 5/2016 | H01T 13/20 |

OTHER PUBLICATIONS

Extended European Search Report issued in corresponding European Patent Application No. 17152446.5, dated Jun. 26, 2017.

* cited by examiner

*Primary Examiner* — Donald Raleigh
*Assistant Examiner* — Kevin Quarterman
(74) *Attorney, Agent, or Firm* — Kusner & Jaffe

(57) ABSTRACT

A method for manufacturing a spark plug comprises: welding a ground electrode to a tip of a metal shell (metallic shell); and removing a welding sag formed on and over inner surfaces of the ground electrode and the metal shell from a work in which the ground electrode is welded to the tip of the metal shell, the welding step including: cutting the welding sag using a working tool while a control unit controls a working position of the working tool with respect to the work; and measuring a remaining quantity of the welding sag after the cutting step and the control unit performing a feedback of a measured value of the remaining quantity of the welding sag measured in the measuring step to a working position of a working tool in the cutting step for the subsequent work.

6 Claims, 10 Drawing Sheets

METHOD FOR MANUFACTURING SPARK PLUG

RELATED APPLICATIONS

This application is based on a prior Japanese Patent Application No. 2016-011265 filed in Japan on Jan. 25, 2016. The entire content of this Japanese Patent Application is hereby incorporated by reference.

FIELD OF THE INVENTION

The present invention relates to a method for manufacturing a spark plug.

BACKGROUND OF THE INVENTION

In general, a spark plug includes a center electrode and a ground electrode. The center electrode is projected from a tip of an insulator in a state where the center electrode is retained by an axial hole of the insulator. On the other hand, the ground electrode is joined to a tip section of a metal shell (also called a metallic shell but hereinafter called the metal fitting) through a welding. When the ground electrode is welded to the metal shell, a welding sag is generated on a surrounding of its welded section. The welding sag is usually removed by a machining such as a blanking punch, as described in a pre-published document of a Japanese Patent Laid-open Application Publication (tokkai) No. 2011-175985 published on Sep. 8, 2011.

In recent years, in order to respond to a downsizing of an internal combustion engine and an improvement in a fuel consumption of the internal combustion engine, a reduction in a diameter of the spark plug has been advanced. In association with the reduction in the diameter of the spark plug, a radial clearance between the metal shell and the insulator becomes narrow so that there is a tendency of generating a, so-called, lateral flying spark (a spark is not generated in a regular spark discharge gap). Conventionally, in order to secure a radial directional clearance between the metal shell and the insulator, the welding sag on inner surface sides of the metal shell and the insulator is removed through the machining after the welding of the ground electrode. However, it is difficult to sufficiently remove the welding sag. Therefore, a task such that, in part of the spark plugs such as a high ignitability spark plug or so forth, it is difficult to secure a demanded clearance.

SUMMARY OF THE INVENTION

The present invention is created to address the above-described task and it is possible to realize the present invention as the following form.

(1) According to the present invention, there is provided a method for manufacturing a spark plug, the spark plug including: a metal shell housing an insulator; and a ground electrode joined to a tip of the metal shell. This method comprises: a welding step of welding the ground electrode to the tip of the metal shell; and a removing step of removing a welding sag formed on and over inner surfaces of the ground electrode and the metal shell from a work in which the ground electrode is welded to the tip of the metal shell. The welding step includes: a cutting step of cutting the welding sag using a working tool while a control unit controls a working position of the working tool with respect to the work; and a measuring step of measuring a remaining quantity of the welding sag after the cutting step.

The control unit performs a feedback of a measured value of the remaining quantity of the welding sag measured in the measuring step to the working position of the working tool in the cutting step for the subsequent work.

According to this method, while the control unit controls the working position of the working tool with respect to the work and the welding sag is cut using the working tool, the welding sag can assuredly be reduced without injury of a part other than a welding sag part. In addition, since the remaining quantity of the welding sag measured in the measuring step is feedback to the working position of the working tool in the cutting step of the subsequent work, the welding sag can more accurately be reduced. A required clearance can be assured between the metal shell and the insulator.

(2) In accordance with a second aspect of the presented invention, there is provided a manufacturing method as described above, wherein the removing step further includes: a photographing step of photographing the work using a camera before the cutting step; a working position determining step of determining the working position of the working tool with respect to the work by a process of an image obtained in the photographing step through the control unit, wherein, in the working position determination step, the control unit determines the working position of the working tool with respect to the work using a measured value of a remaining quantity of the welding sag in a previous work which has been subjected to the removing step before the work.

According to this manufacturing method, since the working position of the working tool with respect to the work is determined using the remaining quantity of the welding sag in a previous work which has been subjected to the removing step before the work, it is possible to accurately perform the removing of the welding sag with respect to the work.

(3) In accordance with a third aspect of the present invention, there is provided a manufacturing method as described above, wherein, in the measuring step, the remaining quantity of the welding sag may be measured using a laser displacement gauge.

Since, according to this method, the remaining quantity of the welding sag is measured using the laser displacement gauge, the remaining quantity of the welding sag can accurately be measured.

(4) In accordance with a fourth aspect of the present invention, there is provided a manufacturing method as described above, wherein the control unit performs the feedback in a case where the measured value of the remaining quantity of the welding sag measured in the measuring step is equal to or larger than a feedback threshold value and does not perform the feedback in a case where the measured value of the remaining quantity of the welding sag measured in the measuring step is less than the feedback threshold value.

Since, according to this method, the feedback is performed only in a case where the remaining quantity of the welding sag is equal to or larger than the feedback threshold value, it is easy to appropriately remove the welding sag in the subsequent work.

(5) In accordance with a fifth aspect of the present invention, there is provided a manufacturing method as described above, wherein a determination of whether the feedback is performed or not is made using an average value or a maximum value of remaining quantities of welding sags measured for consecutive M pieces of works.

Since, according to this method, the determination of whether the feedback is made using an average value or a maximum value of the remaining quantities of the welding sags measured in consecutive M pieces of works, an accuracy of the feedback can be increased.

(6) In accordance with a sixth aspect of the present invention, there is provided a manufacturing method as described above, wherein, in a case where every of the remaining quantities of the welding sags measured in consecutive N (N denotes a predetermined integer equal to or larger than 1) pieces of works is equal to or larger than a cutting failure threshold value, a working facility executing the removing step is stopped.

Since, according to this method, the determination of whether the feedback is carried out or not depending upon the average value or the maximum value of the remaining quantities of the welding sags measured in the consecutive M pieces of works (M denotes a predetermined integer equal to or larger than 1), an accuracy of the feedback can be increased.

Since, according to this method, the working facility is stopped in a case where every of the remaining quantities of the welding sags is equal to or larger than a cut failure threshold value, a failure due to an insufficient cut of the welding sag can be suppressed to minimum.

It should be noted that it is possible to realize the present invention in various forms. For example, the present invention is realized in such forms as the method for manufacturing the spark plug, a method for manufacturing a metal shell (metallic shell) for the spark plug, and so forth.

DETAILED DESCRIPTION OF THE INVENTION

Figure 1:
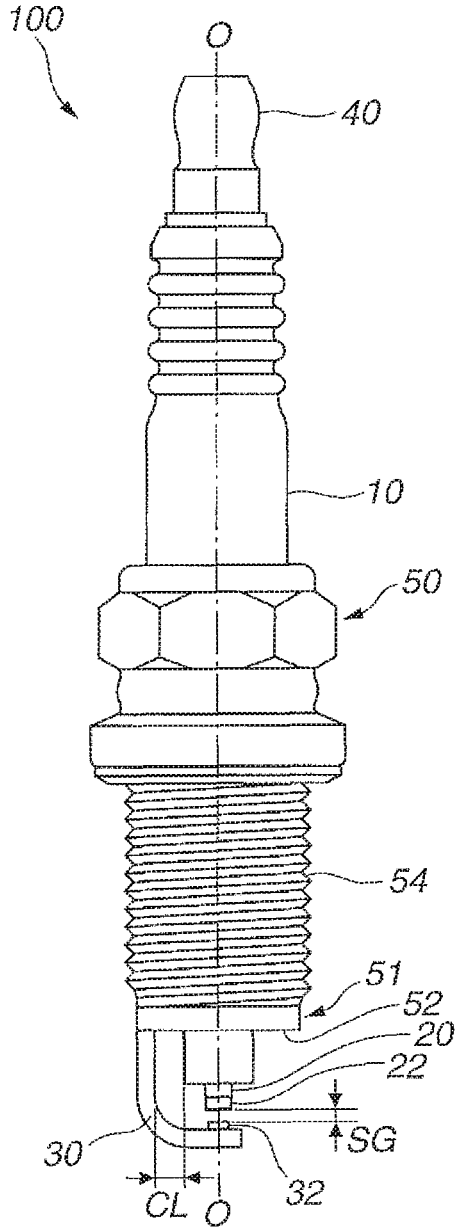
FIG. 1 is a front view of a spark plug as a preferred embodiment according to the present invention.

Hereinafter, reference is made to the accompanied drawings in order to facilitate a better understanding of the present invention. FIG. 1 shows a front view representing a spark plug 100 as a preferred embodiment according to the present invention.

A lower side in which a spark discharge gap SG of spark plug 100 is present is defined as a tip side of spark plug 100. On the other hand, an upper side is defined as a rear end side of spark plug 100. This spark plug 100 includes: an insulator 10; a center electrode 20; a ground electrode 30; a terminal fitting 40; and a metal shell (metallic shell) 50. Insulator 10 has an axial hole extended along an axial line O. It should be noted that axial line O is also called "a center axis."

Center electrode 20 is a rod-shaped electrode extended along axial line O and is retained in a state in which center electrode 20 is inserted into the axial hole of insulator 10.

Ground electrode 30 has one end fixed to a tip surface 52 of a metal shell tip section 51 of metal shell 50 as will be described later and has the other end opposed against center electrode 20. Terminal fitting 40 is a terminal to receive a supply of an electric power and is electrically connected to center electrode 20. A center electrode chip 22 is welded onto a tip of center electrode 20. A ground electrode chip 32 is welded onto an inner surface of ground electrode 30. It is preferable that these chips 22, 32 are made of noble metal chips formed with noble metals such as Platinum (Pt) and Indium (Ir). However, metals other than noble metals may be used. In addition, these chips 22, 32 may be omitted. It should be noted that, in FIG. 1, for convenience of illustration, these chips are depicted having sizes larger than actual chips. A spark discharge gap SG is formed between two chips 22, 32.

Metal shell 50 is a cylindrical member covering the surrounding of insulator 10 and fixes insulator 10 to an inside of metal shell 50. A screw section 54 is formed on an outer periphery of metal shell 50. Screw section 54 is a region of the metal shell on which a thread is formed. When spark plug 100 is attached onto an engine head, the screw section is meshed with a screw hole of the engine head. A metal shell tip section 51 is provided on a tip side of screw section 54.

Figure 2:
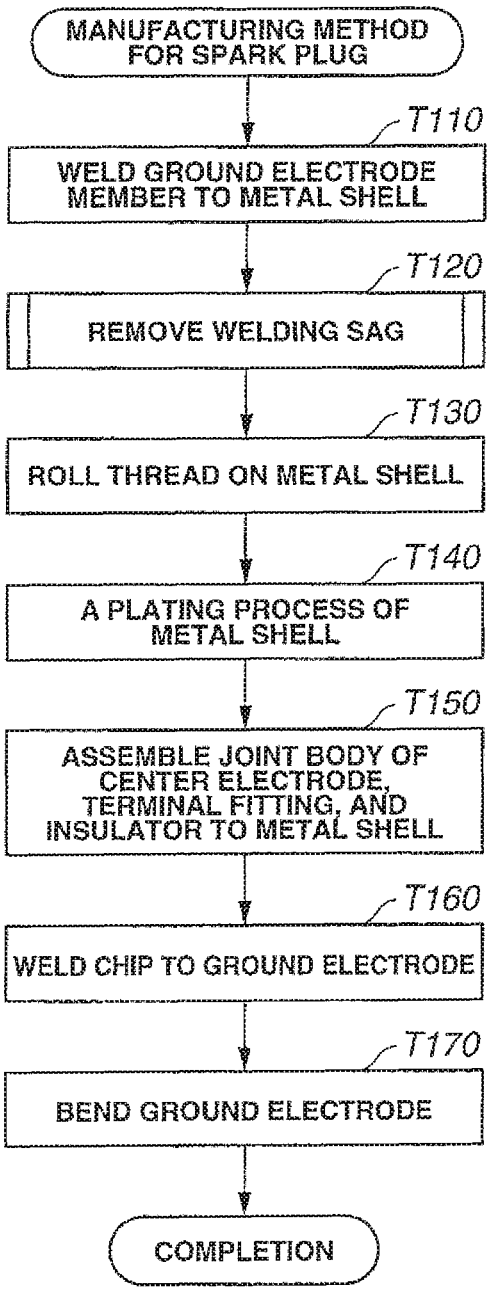
FIG. 2 is a flowchart representing one example of a manufacturing method for the spark plug.

FIG. 2 shows an example of a manufacturing process of the spark plug.

A step T110 is a joint step in which the rod-shaped member of ground electrode 30 is joined in a substantially upright state to tip surface 52 of main body tip section 51. In this joint step, for example, a resistance welding or a laser welding is utilized. Hereinafter, this rod-shaped member is also called a "ground electrode 30."

Figure 3A:
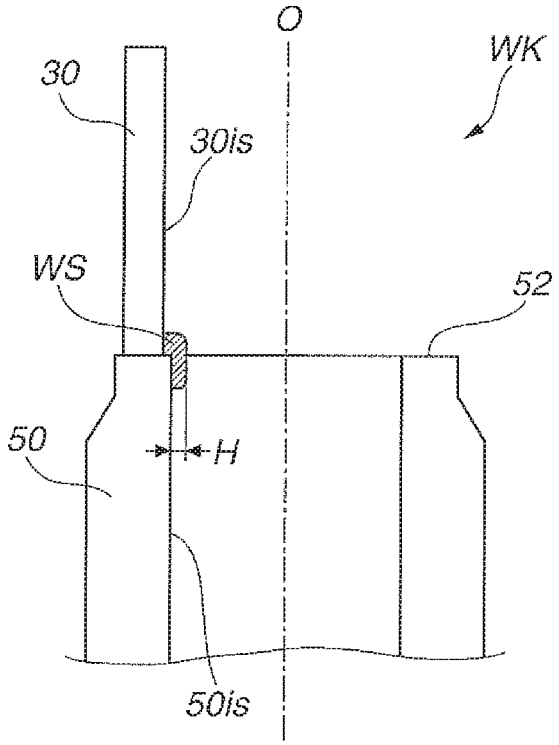
FIGS. 3(A) and 3(B) are a set of explanatory views representing a state in which a ground electrode is joined to a metal shell (metallic shell).
Figure 3B:
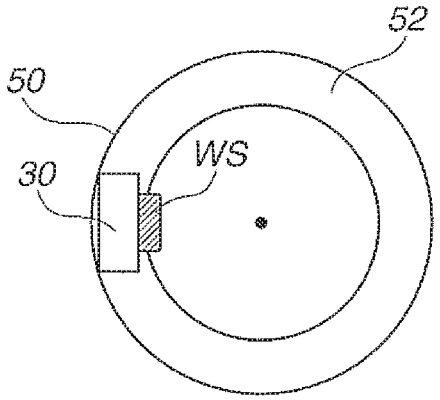

FIG. 3(A) shows an essential part cross sectional view representing a state in which ground electrode 30 is joined to metal shell 50. FIG. 3(B) shows its plan view of the essential part. Ground electrode 30 is in a state before ground electrode 30 is bent in a bending process and is substantially straight rod-shaped member. In this step T110, screw portion 54 (FIG. 1) is not formed on metal shell 50 and a plating process is not treated on metal shell 50 and ground electrode 30. A welding sag WS is formed between metal shell 50 and ground electrode 30. As shown in FIG. 3(B), welding sag WS is extended on a region from an inner surface 50*is* of metal shell 50 toward an inner surface 30*is* of ground electrode 30. As shown in FIG. 3(A), welding sag WS is projected from inner surface 50*is* of metal shell 50 toward a radial directional inner side by a height H. Hereinafter, this height H is called "a projection height H of welding sag WS". Such a welding sag as described above brings out a narrowing of a radial directional clearance CL (FIG. 1) between metal shell 50 and insulator 10 and makes a lateral flying spark easier to be generated. Hence, a removal of welding sag WS at the subsequent step is carried out.

A step T120 in FIG. 2 is the removing step in which welding sag WS is removed so as to make projection height H sufficiently smaller. It should be noted that, in the present specification, such a phrase as "removing the welding sag "means removing a part of welding sag unless specifically noted. In this removing step T120, metal shell 50 to which ground electrode 30 is joined is called "a work WK." Details of removing step T120 will be described later.

In a step T130, screw section 54 is formed on metal shell 50 in a rolling process. In a step T140, a plating process is carried out on a joint body of metal shell 50 and ground electrode 30. In a step T150, a joint body of center electrode 20, terminal fitting 40, and insulator 10 is inserted into an inside of metal shell 50 and assembled. This assembly step includes a caulking step (also called "assembly step") in which a caulked section (not shown) which is located at a rear end of metal shell 50 is caulked to fix insulator 10. In a step T160, ground electrode chip 32 is welded to ground electrode 30. In a step T170, the bending step for ground electrode 30 is carried out. In this way, spark plug 100 shown in FIG. 1 is completed. It should be noted that a sequence of the steps shown in FIG. 2 can properly be modified. For example, steps T160 and T170 may be carried out in a reverse sequence.

Figure 4:
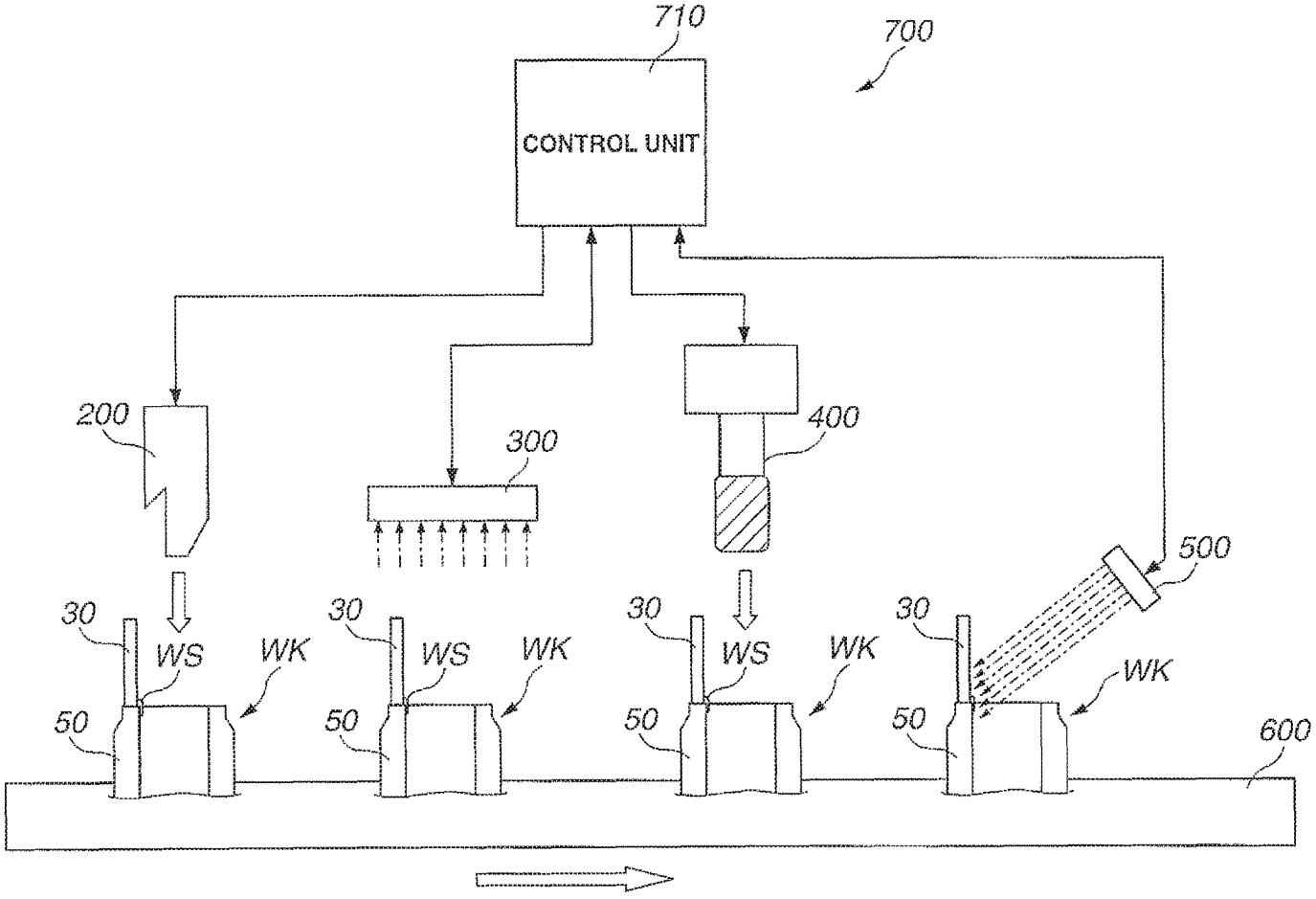
FIG. 4 is an explanatory view representing a working facility used in a welding sag removing step.

FIG. 4 shows an explanatory view representing an example of a working facility 700 used in removing step T120 of welding sag WS. This working facility 700 includes: a control unit 710; a rough processing purpose blanking punch 200; a camera 300; a finishing purpose endmill 400; a laser displacement gauge 500; and a carrier unit 600. Work WK is carried sequentially to individual working positions by carrier unit 600.

Figure 5:
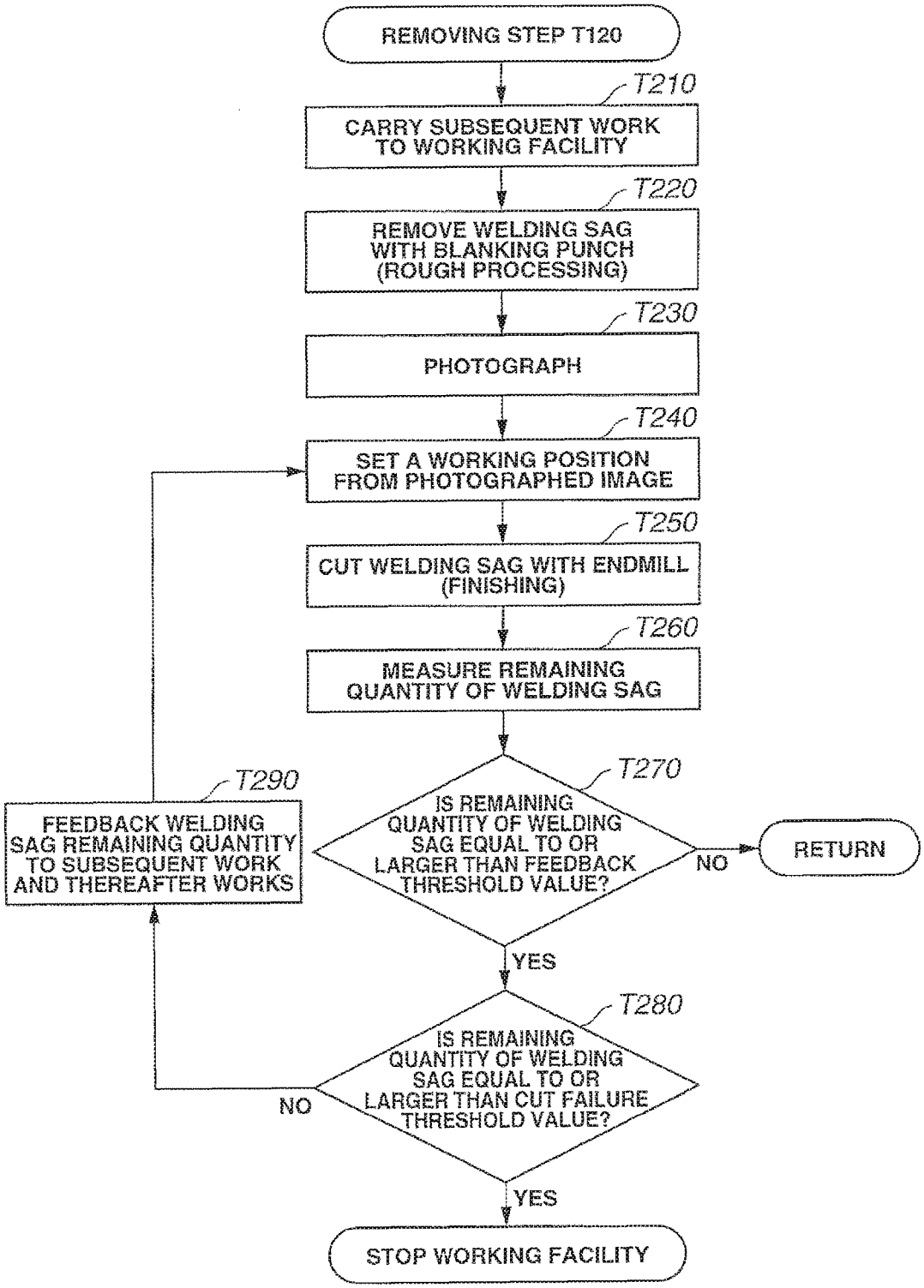
FIG. 5 is a flowchart representing details of the welding sag removing step.

FIG. 5 shows a flowchart representing the details of removing step T120 of welding sag WS. In step T210, subsequent work WK is carried to working facility 700 and the processing after step T220 is executed. In step T220, welding sag WS is removed using the blanking punch.

Figure 6:
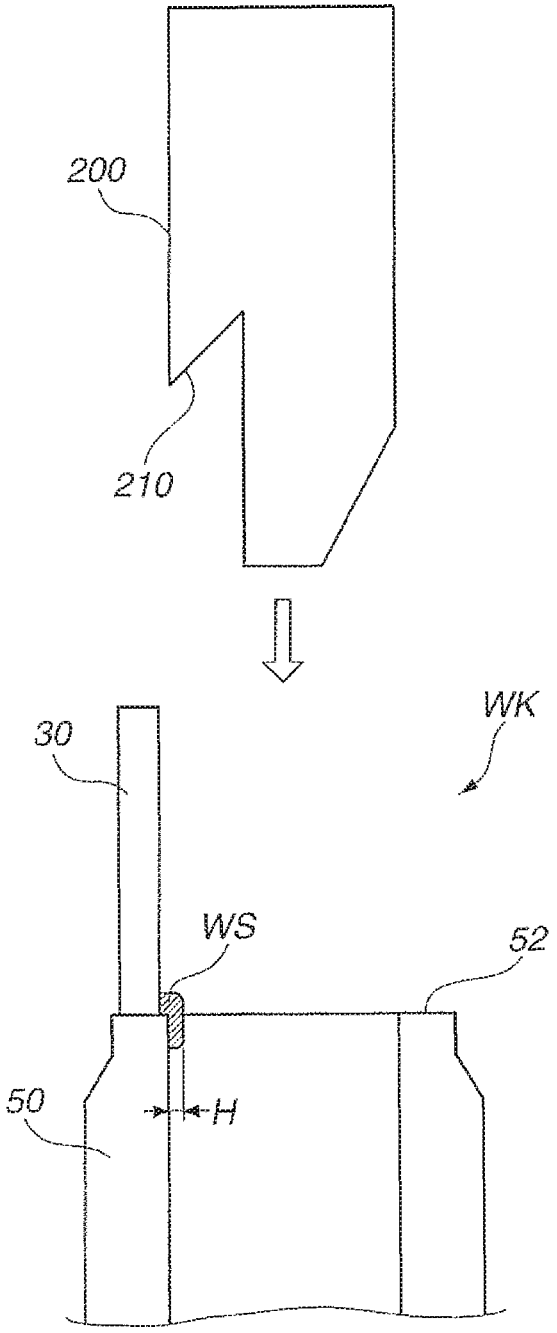
FIG. 6 is an explanatory view representing an example of the welding sag removing step utilizing a blanking punch.

FIG. 6 shows an explanatory view representing a situation under which welding sag WS is removed using blanking punch 200. A cutting blade 210 is formed on a part of blanking punch 200 on which welding sag WS is touched. By inserting blanking punch 200 into an inside of the axial hole of metal shell 200, welding sag WS on a region ranging from inner surface 50*is* of metal shell 50 to inner surface 30*is* of ground electrode 30 can be removed. This step T220 corresponds to the rough processing to remove welding sag WS. It should be noted that step T220 may be omitted.

It is possible to considerably reduce welding sag WS in the removing step of welding sag WS utilizing blanking punch 200. However, it is difficult to completely remove welding sag WS only through the machining using blanking punch 200. This reason is that a case in which welding sag WS cannot sufficiently be removed occurs due to a dimensional tolerance of blanking punch 200 and so forth and the dimensional tolerance of metal shell 50. According to experiments by inventors of the present Application, it was difficult to make projection height H (FIG. 3(A)) of inner surface 50*is* side of metal shell 50 equal to or less than 0.05 mm in the removing step of welding sag WS utilizing the machining. Thus, in this embodiment, by further removing remaining welding sag WS in steps T230 through T280 which will be described in the following, projection height H is further reduced. First, in step T230, work WK is photographed using camera 300 (a photographing section).

Figure 7A:
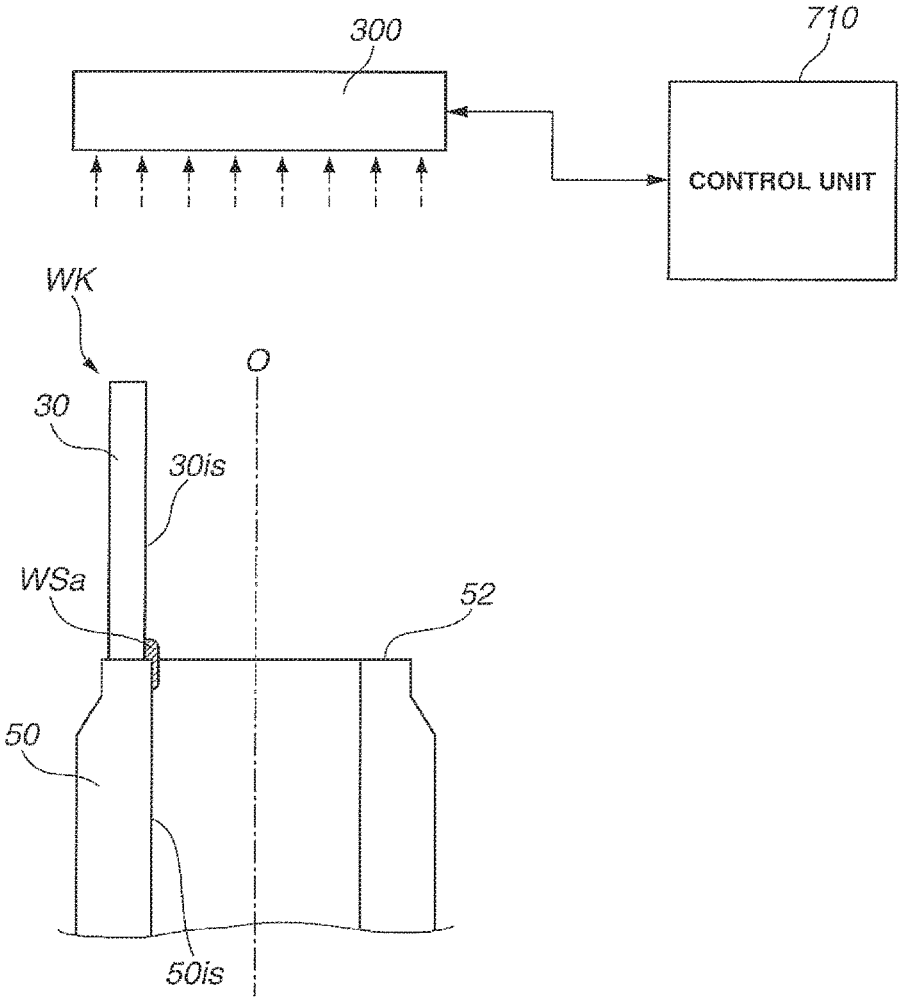
FIGS. 7(A) and 7(B) are a set of explanatory views representing a situation under which a working is photographed using a camera.
Figure 7B:
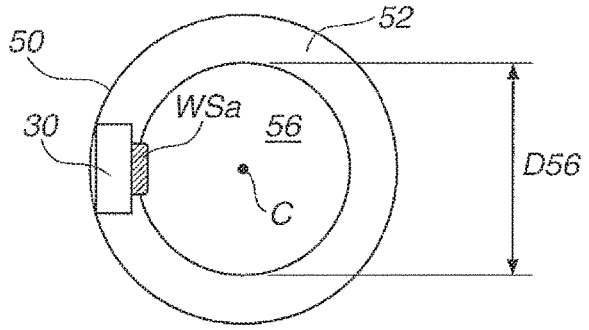

FIGS. 7(A) and 7(B) show a set of explanatory views representing a situation under which work WK is photographed using camera 300, in step T230 of FIG. 5. This camera 300 is arranged at an upper side of work WK in a state in which an optical axis of camera 300 is in parallel to axial line O of work WK and captures a photographed image including metal shell 50, ground electrode 30, and welding sag WSa. This photographed image is substantially the same as the plan view shown in FIG. 7(B).

It should be noted that, since welding sag WSa is partially removed with blanking punch 200 in step T220 of FIG. 5, welding sag WSa becomes smaller than welding sag WS depicted in FIG. 6. The photographed image is supplied from camera 300 to control unit 710.

In a step T240 of FIG. 5, control unit 710 performs an image processing for the photographed image and determines a working position of endmill 400 in the next step T250 in accordance with a result of the image processing. The determination of the working position of endmill 400 preferably includes, for example, the following two processes.

(1) Control unit 710 derives a center position C of axial hole 56 from the photographed image and sets the working position of endmill 400 in such a way that the center axis of endmill 400 is arranged at a predetermined relative position with respect to this center position C. Specifically, for example, control unit 710 sets an initial working position of endmill 400 so that the center axis of endmill 400 becomes coincident with center position C of axial hole 56.

(2) Control unit 710 derives an inner diameter D56 of axial hole 56 and determines a working quantity of endmill 400 (a quantity by which endmill 400 can approach welding sag WS a).

If the working position of endmill 400 is set utilizing such an image processing as described above, influences of a deviation of inner diameter D56 of axial hole 56 of main body metal fitting 50 and a shift of center position C can be eliminated. Hence, a working accuracy can be improved.

It should be noted that it is not necessary to carry out both of above-described items (1) and (2) and either one of items (1) or (2) may be carried out. Or alternatively, the working position of endmill 400 may be determined from the result of image processing of the photographed image by a method other than items (1) and (2). After this step T240, in a step T250, welding sag WSa is cut using endmill 400.

Figure 8:
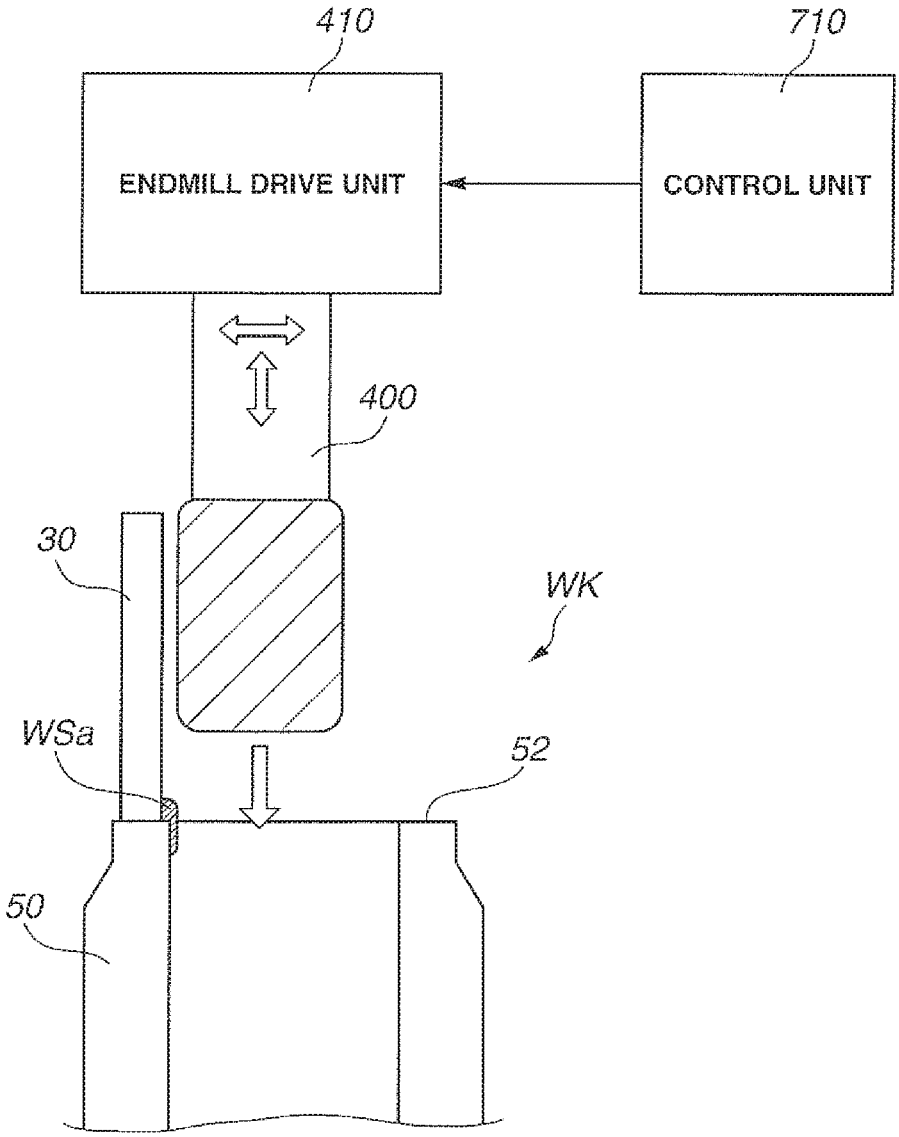
FIG. 8 is an explanatory view representing a situation under which the welding sag is cut using an endmill.

FIG. 8 shows an explanatory view representing a situation under which welding sag WSa is cut using endmill 400. An endmill drive unit 410, in accordance with a command issued from control unit 710, rotates endmill 400 while controlling the working position of endmill 400 to execute the cutting of welding sag WSa. This step T250 corresponds to a finishing (processing) of the welding sag. After this step T250, in a step T260, a measurement of a remaining quantity of the welding sag is executed.

Figure 9:
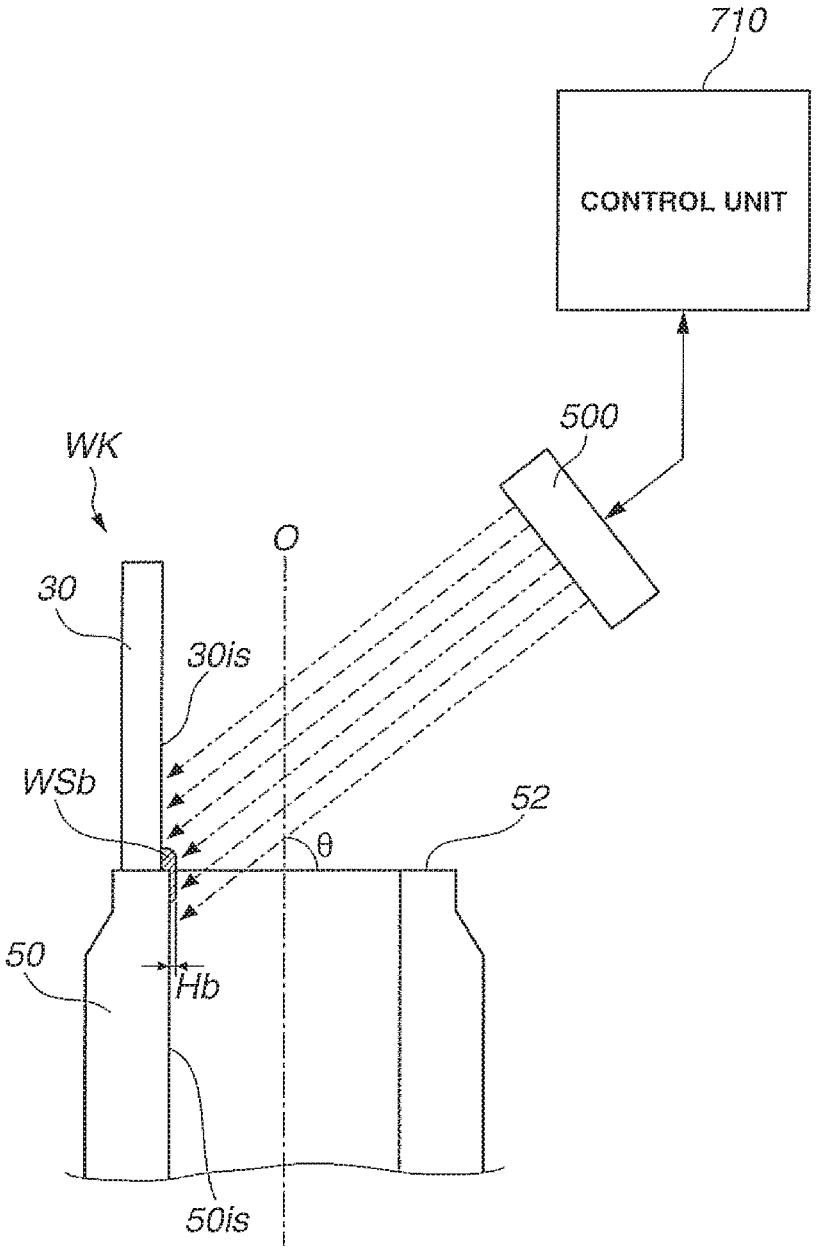
FIG. 9 is an explanatory view representing a situation under which a remaining quantity of the welding sag is measured using a laser displacement gauge.

FIG. 9 shows an explanatory view representing a situation under which the remaining quantity of welding sag WSb is measured using a laser displacement gauge 500. This welding sag WSb is further made smaller than welding sag WSa in FIG. 8 and projection height Hb of welding sag WSb becomes small (low).

The measurement of the remaining quantity of welding sag WSb using laser displacement gauge 500 is, for example, executed in the following procedures (1) and (2).

(1) After laser beams are irradiated from laser displacement gauge 500 through an angle of θ to obtain a displacement data, an output waveform of laser displacement gauge 500 is corrected in accordance with angle θ and a maximum value (namely, projection height Hb) of a step difference between metal shell 50 and welding sag WSb is measured. This maximum value is assumed to be a remaining quantity of welding sag WSb. At this time, it is preferable that work WK is rotating while measuring the remaining quantity and the maximum value of the step differences from among the measured values for a constant time duration.

(2) With the laser beams struck on the center of welding sag WSb, the step difference between the center of welding sag WSb and metal shell 50 is measured and this step difference is assumed to be the remaining quantity of welding sag WSb.

The measured remaining quantity of welding sag WSb is supplied from laser displacement gauge 500 to control unit 710. It should be noted that the measurement of the remaining quantity of welding sag WSb may be carried out using another measurement instrument than laser displacement gauge 500.

In a step T270 of FIG. 5, control unit 710 determines whether the measured value of the remaining quantity of the welding sag is equal to or larger than a feedback threshold value Th1. This feedback threshold value Th1 is a threshold value to determine whether the measured value of the remaining quantity of the welding sag should be fed back to the removing steps of subsequent work WK and works after subsequent work WK and is preset experimentally or empirically. In a case where the measured value of the remaining quantity of the welding sag is equal to or larger than feedback threshold value Th1, the routine goes to a step T280. In a case where the measured value is smaller than feedback threshold value Th1, the routine in FIG. 5 is ended and the routine goes to step T130 of FIG. 2.

In step T280, control unit 710 determines whether the measured value of the remaining quantity of the welding sag is equal to or larger than a cut failure threshold value Th2.

Cut failure threshold value Th2 is a threshold value to determine whether the cutting of the welding sag of work WK under the processing has been insufficient and is preset experimentally or empirically. In a case where the measured value of the remaining quantity of the welding sag is equal to or larger than cut failure threshold value Th2 in step T280, working facility 700 (FIG. 4) is stopped and the subsequent removing step is stopped. In this way, an increase of failed (pieces of) works can be prevented. An administrator of working facility 700, for example, checks to determine whether such a defect as a breakage of the blade of endmill 400, a deterioration of the blade or so forth has occurred. If the defect occurs in endmill 400, with a replacement of endmill 400, working facility 700 can be re-run.

It should be noted that in a case where, in step T280, the measured value of the remaining quantity of the welding sag is smaller than cut failure threshold value Th2, the routine goes to a step T290. In step T290, control unit 710 performs a feedback of the measured value of the remaining quantity of the working sag measured at step T260 to the processing of subsequent work WK and works after subsequent work WK. Then, the routine in FIG. 5 goes from step T290 to step T240. Then, in step T240, control unit 710 determines the working position of endmill 400 with respect to work WK using the measured value of the remaining quantity of the welding sag in a previous work which has been subjected to the removing step before the present work WK. Specifically, for example, in the removing step of subsequent work WK, the working quantity of endmill 400 (namely, a quantity by which endmill 400 can approach welding sag WSa in FIG. 8) is increased in accordance with the measured value of the remaining quantity of the welding sag. In this way, the remaining quantities of the welding sags in subsequent work WK and the works after subsequent work WK can be reduced. Then, the routine finally returns to step T130 of FIG. 2 via step T270.

The feedback of the remaining quantity of the welding sag in step T290 may be carried out in accordance with the measured value of one piece of work WK. However, this feedback may be carried out in accordance with the measured values of consecutive M (a predetermined integer equal to or larger than 1) pieces of works WK. In the latter case, it is preferable that, for example, the feedback is carried out using an average value or a maximum value of the measured values of M pieces of works WK. In addition, the determination in step T270 is preferably carried out using the average value or the maximum value of nearest M pieces of works WK including presently measured work WK. It should be noted that, in a case where M=1, "the consecutive M pieces" has the same meaning as "one piece." If the value of M is equal to or larger than 2, it is possible to reduce the quantity of data required for the feedback.

In the same way, the determination of a presence or an absence of the stop of working facility 700 in step T280 may be made in accordance with the measured value of one piece of work WK. However, the determination of the presence or the absence of the stop of working facility 700 may be made in accordance with the measured values of consecutive N pieces of works WK (N is a predetermined integer equal to or larger than 1). In the latter case, for example, in a case where all of consecutive N pieces of works WK are equal to or larger than cut failure threshold value Th2, it is preferable that working facility 700 is stopped. It should be noted that, if N=1, "the consecutive N pieces of works WK" have the same meaning as "one piece." It should be noted that M pieces of works WK used in steps T270 and T290 may be preset to be the same value as N pieces of works WK or may be preset to be different from each other.

Figure 10:
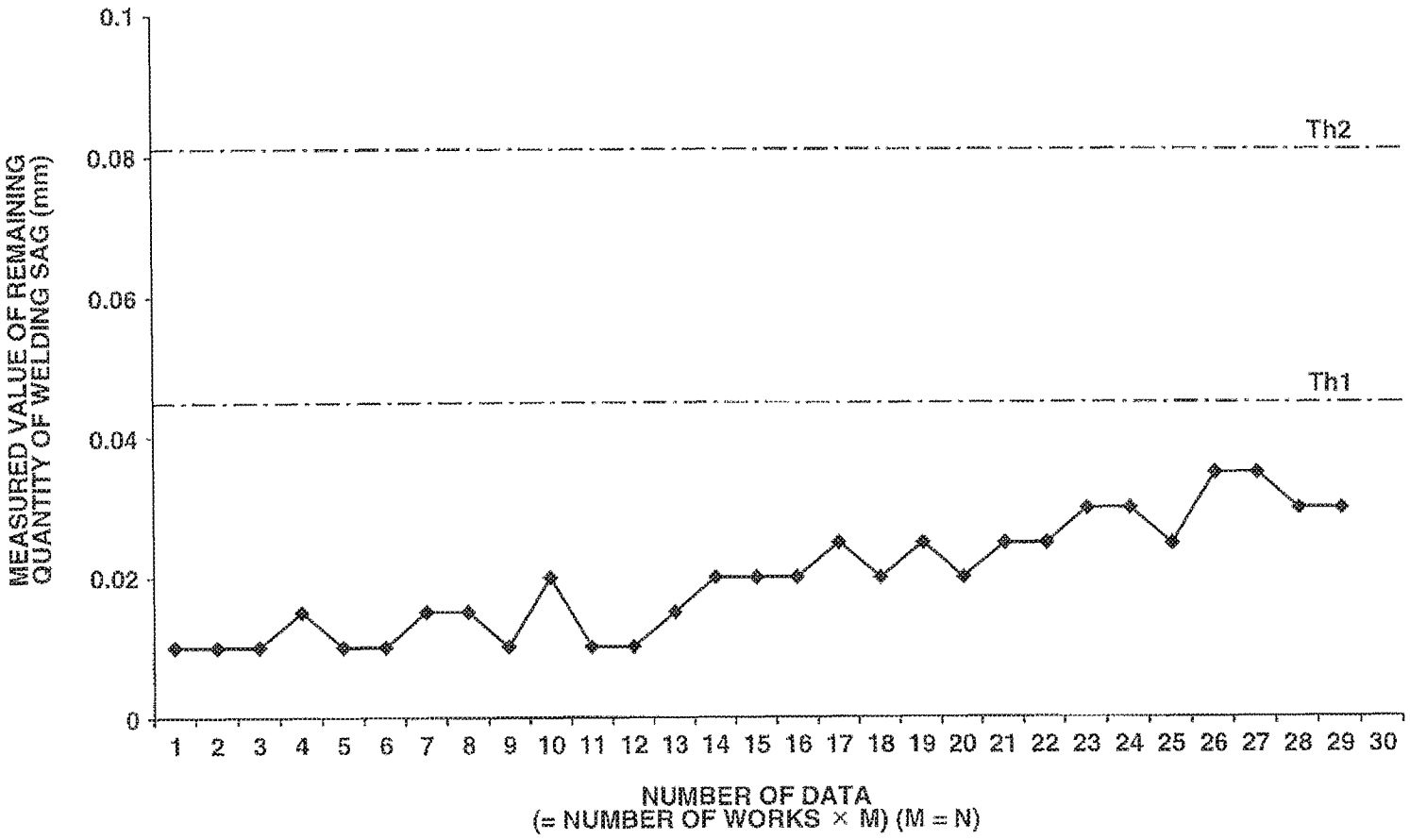
FIG. 10 is a graph representing an example of a transition of measured values of remaining quantities of the welding sags of works.

FIG. 10 is a graph representing one example of a transition of the measured values of the remaining quantities of the welding sags in the preferred embodiment. A lateral axis shown in FIG. 10 denotes a number of data and a longitudinal axis denotes the remaining quantity of the welding sag measured in step T260 in FIG. 5. It should be noted that the data in the present specification has a meaning of the average value (or the maximum value) of the measured values of the remaining quantities of the welding sags on the consecutive M number of pieces of works WK.

In this embodiment, M pieces of works WK used in steps T270 and T290 are preset to the same value (for example, M=N=10). That is, the average value (a moving average) of the remaining quantities of the welding sags related to M pieces of works WK is the measured value corresponding to one data (one time data). In this case, a value of the measured number of works WK divided by M provides the number of actually obtained data. In addition, feedback threshold value Th1 and cut failure threshold value Th2 (Th1<Th2) are preset.

As explained on a basis of FIG. 5, when the measured value of the remaining quantity of the welding sag becomes equal to or larger than feedback threshold value Th1, the measure value is fed back to the cutting work of endmill 400 in subsequent work WK and the works after subsequent work WK. In addition, when the measured value of the remaining quantity of the welding sag becomes equal to or larger than cut failure threshold value Th2, working facility 700 is stopped.

As described above, in the preferred embodiment, while control unit 710 controls the working position of endmill 400 with respect to work WK, control unit 710 cuts welding sag WS using endmill 400. Hence, welding sag WS can assuredly be made smaller without injury of a part of work WK except the sag part. In addition, a required clearance between metal shell 50 and insulator 10 can be assured. Furthermore, since the remaining quantity of welding sag WS measured in measurement step T260 is fed back to the working position of endmill 400 in cutting step T250 for subsequent work WK, welding sag WS in subsequent work WK can more accurately be smaller. Specifically, projection height Hb (FIG. 9) of welding sag WSb could be made equal to or lower than 0.05 mm.

MODIFICATIONS

It should be noted that the present invention is not limited to the above-described embodiment and is possible to be carried out in various forms in a range without departing from the gist of the present invention and the scope of the claims.

Modification 1

The present invention is applicable to the spark plugs having the various structures other than FIG. 1.

Especially, various modifications are possible for the specific shapes such as terminal fittings and insulators. In addition, in this embodiment, as the working tool, the endmill is used. However, the present invention is not limited to this and a cutting tool and a grinding tool such as a cemented carbide cutter and a grindstone may be used as the working tool. It is preferable that a working tool which can adjust the cutting quantity or grinding quantity is used by the approach of the working position of the working tool to the welding sag while the working is carried out in a state in which the working tool is brought in contact with the welding sag.

Modification 2

The manufacturing step (method) shown in FIG. 2 is merely one example and various modifications are possible. For example, an execution time period of removing step of the welding sag may be modified. For example, removing step T120 of the welding sag may be executed after the rolling step T130.

While the present invention has been described with reference to the embodiment and the modifications, the description of the embodiment is intended to aid an understanding of the present invention and not to limit the present invention. Various modifications and improvements may be made in the present invention without departing from the spirit of the invention and the scope of the claims, and the present invention includes equivalents thereof.

This application is based on a prior Japanese Patent Application No. 2016-011265 filed in Japan on Jan. 25, 2016. The entire contents of this Japanese Patent Applications are hereby incorporated by reference.

REFERENCE NUMERALS AND SIGNS

10 . . . insulator,
20 . . . center electrode,
22 . . . center electrode chip,
30 . . . ground electrode (ground electrode member),
30*is* . . . inner surface of ground electrode,
32 . . . ground electrode chip,
40 . . . terminal fitting,
50 . . . metal shell (metallic shell),
50*is* . . . inner surface of metal shell,
51 . . . tip section of metal shell,
52 . . . tip surface,
54 . . . screw section,
56 . . . axial hole,
100 . . . spark plug,
200 . . . blanking punch,
210 . . . cutting blade,
300 . . . camera,
400 . . . endmill (working tool),
410 . . . endmill drive unit,
500 . . . laser displacement gauge,
600 . . . carrier unit,
700 . . . working facility,
710 . . . control unit.

Having described the invention, the following is claimed:

1. A method for manufacturing a spark plug, the spark plug including: a metal shell housing an insulator; and a ground electrode joined to a tip of the metal shell, the method comprising:

a welding step of welding the ground electrode to the tip of the metal shell; and a removing step of removing a welding sag formed on and over inner surfaces of the ground electrode and the metal shell from a work in which the ground electrode is welded to the tip of the metal shell, wherein the removing step includes:

a cutting step of cutting the welding sag using a working tool while a control unit controls a working position of the working tool with respect to the work; and a measuring step of measuring a remaining quantity of the welding sag after the cutting step, and wherein the control unit performs a feedback of a measured value of the remaining quantity of the welding sag measured in the measuring step to the working position of the working tool in the cutting step for the subsequent work.

2. The method for manufacturing the spark plug as claimed in claim 1, wherein the removing step further includes:

a photographing step of photographing the work using a camera before the cutting step;

a working position determining step of determining the working position of the working tool with respect to the work by a process of an image obtained in the photographing step through the control unit, wherein, in the working position determination step, the control unit determines the working position of the working tool with respect to the work using the measured value of the remaining quantity of the welding sag in a previous work which has been subjected to the removing step before the work.

3. The method for manufacturing the spark plug as claimed in claim 2, wherein, in the measuring step, the remaining quantity of the welding sag is measured using a laser displacement gauge.

4. The method for manufacturing the spark plug as claimed in claim 1, wherein the control unit performs the feedback in a case where the measured value of the remaining quantity of the welding sag measured in the measuring step is equal to or larger than a feedback threshold value and does not perform the feedback in a case where the measured value of the remaining quantity of the welding sag measured in the measuring step is smaller than the feedback threshold value.

5. The method for manufacturing the spark plug as claimed in claim 4, wherein a determination of whether the feedback is performed or not is made using an average value or a maximum value of remaining quantities of welding sags measured for consecutive M pieces of works (M: a predetermined integer equal to or larger than 1).

6. The method for manufacturing the spark plug as claimed in claim 1, wherein, in a case where every of remaining quantities of welding sags measured in consecutive N pieces of works is equal to or larger than a cutting failure threshold value, a working facility executing the removing step is stopped (N: a predetermined integer equal to or larger than 1).

* * * * *